US012753351B2

(12) United States Patent
Kendall et al.

(10) Patent No.: US 12,753,351 B2
(45) Date of Patent: Oct. 6, 2026

(54) PROCESSES AND SYSTEMS FOR STEAM CRACKING HYDROCARBON FEEDS

(71) Applicant: ExxonMobil Chemical Patents Inc., Baytown, TX (US)

(72) Inventors: James L. Kendall, Humble, TX (US); John R. DeLaney, Houston, TX (US); Mark A. Nierode, Kingwood, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 165 days.

(21) Appl. No.: 18/693,664

(22) PCT Filed: Oct. 14, 2022

(86) PCT No.: PCT/US2022/078086

§ 371 (c)(1),
(2) Date: Mar. 20, 2024

(87) PCT Pub. No.: WO2023/076809

PCT Pub. Date: May 4, 2023

(65) Prior Publication Data

US 2024/0392201 A1 Nov. 28, 2024

Related U.S. Application Data

(60) Provisional application No. 63/271,557, filed on Oct. 25, 2021.

(51) Int. Cl.
*C10G 47/32* (2006.01)
*C10G 47/36* (2006.01)

(52) U.S. Cl.
CPC ..... *C10G 47/32* (2013.01); *C10G 47/36* (2013.01); *C10G 2300/1033* (2013.01); *C10G 2300/4006* (2013.01); *C10G 2300/807* (2013.01)

(58) Field of Classification Search
CPC ..... C10G 47/32; C10G 47/36; C10G 2300/1033; C10G 2300/4006;
(Continued)

(56) References Cited

U.S. PATENT DOCUMENTS 3,557,241 A 1/1971 Kivlen
7,090,765 B2 8/2006 Spicer et al.
(Continued)

FOREIGN PATENT DOCUMENTS

WO 0155280 A1 8/2001
WO 2009026488 A2 2/2009
(Continued)

*Primary Examiner* — Juan C Valencia
(74) *Attorney, Agent, or Firm* — WOMBLE BOND DICKINSON (US) LLP; Kevin Davis

(57) ABSTRACT

Processes and systems for steam cracking hydrocarbons. Liquid water can be combined with a preheated hydrocarbon feed to produce a mixture, which can be heated to produce a heated mixture. At least a portion of the heated mixture can be steam cracked to produce an effluent. A process gas, a steam cracker naphtha, a condensed process water, and one or more heavy steam cracker products can be separated from the effluent. The condensed process water can include entrained hydrocarbons and at least a portion of the entrained hydrocarbons can be separated therefrom to produce a purified process water. At least a portion of the purified process water can be heated to produce dilution steam. The liquid water combined with the preheated hydrocarbon feed can include a portion of the condensed process water, a portion of the purified process water, condensed dilution steam, or a mixture thereof.

25 Claims, 2 Drawing Sheets

(58) Field of Classification Search
CPC ..... C10G 2300/807; C10G 2300/805; C10G 31/06; C10G 31/08; C10G 9/36
See application file for complete search history.

(56) References Cited

U.S. PATENT DOCUMENTS

| | | | | |
|---|---|---|---|---|
| 7,138,047 | B2 | 11/2006 | Stell et al. | |
| 2005/0209495 | A1* | 9/2005 | McCoy | C10G 9/20 208/132 |
| 2009/0022635 | A1 | 1/2009 | Zhao et al. | |
| 2016/0168480 | A1 | 6/2016 | Spicer | |
| 2020/0123459 | A1 | 4/2020 | Al-Ghamdi et al. | |
| 2020/0172814 | A1 | 6/2020 | Oud | |
| 2023/0151283 | A1 | 5/2023 | Nierode et al. | |
| 2024/0166961 | A1* | 5/2024 | Dittrich | B01J 6/008 |

FOREIGN PATENT DOCUMENTS

| | | | |
|---|---|---|---|
| WO | 2020191253 | A1 | 9/2020 |
| WO | 2021148942 | A1 | 7/2021 |
| WO | 2022081431 | A1 | 4/2022 |

* cited by examiner

PROCESSES AND SYSTEMS FOR STEAM CRACKING HYDROCARBON FEEDS

CROSS-REFERENCE TO RELATED APPLICATIONS

This application is a US national phase application of PCT Application Serial No. PCT/US2022/078086 having a filing date of Oct. 14, 2022, which claims priority to and the benefit of U.S. Provisional Application No. 63/271,557 having a filing date of Oct. 25, 2021, the disclosures of all of which are incorporated herein by reference in their entireties.

FIELD

Embodiments disclosed herein generally relate to processes and systems for steam cracking hydrocarbons. More particularly, such embodiments relate to processes and systems for steam cracking a hydrocarbon feed by combining liquid water as a substitute for or as a supplement to dilution steam with a preheated hydrocarbon feed.

BACKGROUND

Steam cracking has long been used to crack various hydrocarbon feedstocks into olefins. Conventional steam cracking utilizes a furnace that has two main sections: a convection section and a radiant section. A hydrocarbon feedstock and steam mixture can enter the convection section of the furnace as a liquid (except for light feedstocks which enter as a vapor) where it is typically heated and at least partially vaporized by indirect heat exchange with hot flue gas from the radiant section to produce a heated mixture. The heated mixture is introduced into the radiant section where the cracking takes place. The resulting products including olefins leave the furnace for further downstream processing, such as quenching and separating various products therefrom.

The temperature of the heated mixture introduced into the radiant section fluctuates as the furnace load varies. One attempt to control the temperature of the heated mixture has been to import fresh boiler feed water into the steam cracking facility and mix the water with the hydrocarbon feedstock and steam during heating within the convection section. The imported fresh boiler feed water mixed with the hydrocarbon feedstock and steam becomes incremental blowdown from the system and increases the amount of wastewater that needs to be properly treated and disposed of. Reducing the amount of wastewater produced in the system can save significant capital and operating costs, improve sustainability, and reduce the use of fresh boiler feed water, thereby, reducing the amount of water used in the system.

There is a need, therefore, for improved processes and systems for steam cracking a hydrocarbon feed while reducing the amount of fresh boiler feed water imported into the system. This disclosure satisfies this and other needs.

SUMMARY

Processes and systems for steam cracking hydrocarbons are provided. In some embodiments, the process can include heating a hydrocarbon feed to produce a preheated hydrocarbon feed. Liquid water can be combined with the preheated hydrocarbon feed to produce a mixture. The mixture can be heated within a convection section of a steam cracker furnace to produce a heated mixture. At least a portion of the heated mixture can be steam cracked within a radiant section of the steam cracker furnace to produce a steam cracker effluent. A process gas that can include molecular hydrogen and $C_1$-$C_4$ hydrocarbons, a steam cracker naphtha, a condensed process water, and one or more heavy steam cracker products can be separated from the steam cracker effluent. The condensed process water can include entrained hydrocarbons. At least a portion of the entrained hydrocarbons can be separated from the condensed process water to produce a purified process water. At least a portion of the purified process water can be heated to produce dilution steam. The liquid water combined with the preheated hydrocarbon feed can be or can include at least one of the following: (i) a portion of the condensed process water, (ii) a portion of the purified process water, (iii) condensed dilution steam, and (iv) a mixture or two or more of (i), (ii), and (iii).

In some embodiments, the system for steam cracking hydrocarbons can include a steam cracker that can include a convection section and a radiant section. A first convection line can be disposed within the convection section and can be configured to flow a hydrocarbon feed therethrough to produce a preheated hydrocarbon feed. A mixing device can be in fluid communication with the first convection line and can be configured to receive the preheated hydrocarbon feed and a liquid water feed produce a mixture. A second convection line can be disposed within the convection section and can be configured to receive and flow the mixture therethrough to produce a heated mixture. A radiant line can be disposed within the radiant section and can be configured to receive and flow at least a portion of the heated mixture therethrough to produce a steam cracker effluent. A first separation stage can be configured to separate a process gas that can include molecular hydrogen and $C_1$-$C_4$ hydrocarbons, a steam cracker naphtha, a condensed process water, and one or more heavy steam cracker products from the steam cracker effluent. The condensed process water can include entrained hydrocarbons. A second separation stage can be configured to separate at least a portion of the entrained hydrocarbons from the condensed process water to produce a purified process water. A dilution steam generator can be configured to heat at least a portion of the purified process water to produce dilution steam. The system can also include at least one of: a first recycle line that can be configured to convey a portion of the condensed process water from the first separation stage to the mixing device to provide at least a portion of the liquid water received by the mixing device; a second recycle line that can be configured to convey a portion of the purified process water from the second separation stage to the mixing device to provide at least a portion of the liquid water received by the mixing device; and a third recycle line that can be configured to convey a condensed dilution steam from an optional dilution steam condenser to the mixing device to provide at least a portion of the liquid water received by the mixing device.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
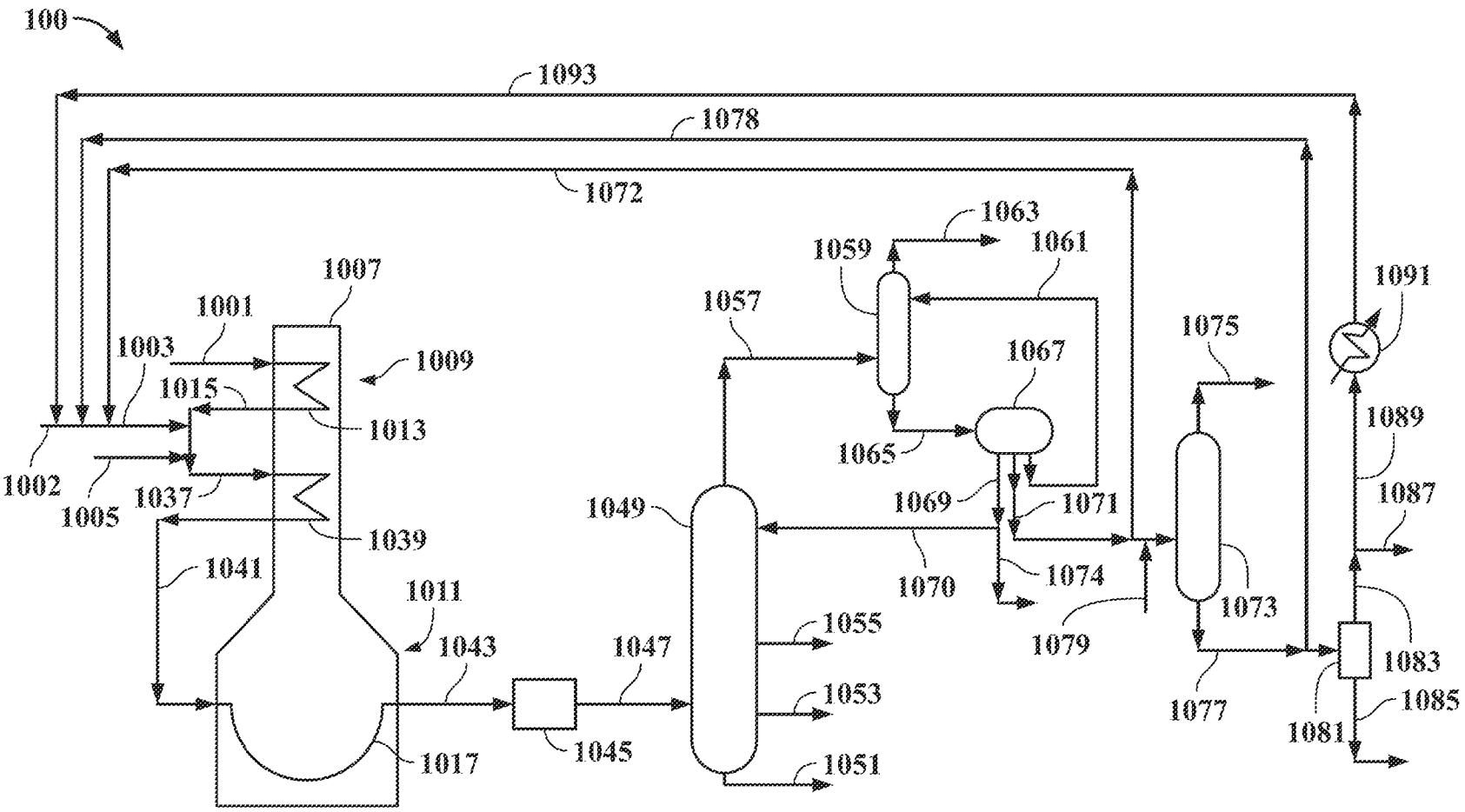
FIG. 1 depicts a schematic of an illustrative system for steam cracking a mixture produced by mixing a preheated hydrocarbon feed, water, and optionally steam within a radiant section of a steam cracker furnace to produce a steam cracker effluent that can be cooled and separated into a plurality of products, according to one or more embodiments described.

It is to be understood that the following disclosure describes several exemplary embodiments for implementing different features, structures, and/or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the exemplary embodiments presented below can be combined in any combination of ways, i.e., any element from one exemplary embodiment can be used in any other exemplary embodiment, without departing from the scope of the disclosure.

The indefinite article "a" or "an", as used herein, means "at least one" unless specified to the contrary or the context clearly indicates otherwise. Thus, embodiments using "a separator" include embodiments where one or two or more separators are used, unless specified to the contrary or the context clearly indicates that only one separator is used. Likewise, embodiments using "a separation stage" include embodiments where one or two or more separation stages are used, unless specified to the contrary.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

As used herein, the term "hydrocarbon" means a class of compounds containing hydrogen bound to carbon. The term "$C_n$" hydrocarbon means hydrocarbon having n carbon atom(s) per molecule, where n is a positive integer. The term "$C_{n+}$" hydrocarbon means hydrocarbon having at least n carbon atom(s) per molecule, where n is a positive integer. The term "$C_{n-}$" hydrocarbon means hydrocarbon having no more than n number of carbon atom(s) per molecule, where n is a positive integer. "Hydrocarbon" encompasses (i) saturated hydrocarbon, (ii) unsaturated hydrocarbon, and (iii) mixtures of hydrocarbons, including mixtures of hydrocarbon compounds (saturated and/or unsaturated), including mixtures of hydrocarbon compounds having different values of n.

As used herein, the term "hydrocarbon feed" means any feed that includes hydrocarbon and is suitable for producing $C_2$-unsaturated hydrocarbons, e.g., ethylene and/or propylene, by pyrolysis, such as by steam cracking. Typical hydrocarbon feeds include ≥10% hydrocarbon (weight basis, based on the weight of the hydrocarbon feed), e.g., ≥50%, such as ≥90%, or ≥95%, or ≥99%.

FIG. 1 depicts a schematic of an illustrative system 100 for steam cracking a mixture in line 1041 produced by mixing a preheated hydrocarbon feed in line 1015, water in line 1003, and optionally steam in line 1005 within a radiant section 1011 of a steam cracker furnace 1007 to produce a steam cracker effluent via line 1043 that can be cooled and separated into a plurality of products, according to one or more embodiments. At least a portion of the water in line 1003 can be separated from the steam cracker effluent. In some embodiments, at least a portion of the water in line 1003 can include a condensed process water recycled via line 1072, a purified process water recycled via line 1078, condensed dilution steam recycled via line 1093, or a combination thereof. In some embodiments, the water in line 1003 can be formed exclusively from one or more of the following: (i) the condensed process water in line 1072, (ii) the purified process water in line 1078, (iii) the condensed dilution steam in line 1093, (iv) a mixture of two more of (i), (ii), and (iii). In other embodiments, a portion of the water in line 1003 can also include fresh boiler feed water via line 1002.

The hydrocarbon feed in line 1001 can be heated to produce a preheated hydrocarbon feed. Heating of the hydrocarbon feed can take any form known by those of ordinary skill in the art. In some embodiments, heating the hydrocarbon feed in line 1001 can include indirect contact of the hydrocarbon feed in the convection section 1009 of the furnace 1007 with hot flue gases from a radiant section 1011 of the furnace 1007 to produce a preheated hydrocarbon feed in line 1015. This can be accomplished, by way of a non-limiting example, by passing the hydrocarbon feed through a bank of heat exchange tubes 1013 located within the convection section 1009 of the furnace 1007. In some embodiments, the preheated hydrocarbon feed in line 1015 can be at a temperature in a range of from 100° C., 125° C., 150° C., 175° C., 200° C., or 225° C. to 250° C., 275° C., 300° C., 325° C., or 350° C.

The preheated hydrocarbon feed in line 1015 can be mixed with the liquid water in line 1003 to produce a mixture in line 1037. In some embodiments, the preheated hydrocarbon feed in line 1015 can be mixed with the liquid water in line 1003 and, optionally, with steam, e.g., primary dilution steam, in line 1005 to produce the mixture in line 1037. In some embodiments, when both liquid water and steam are mixed with the preheated hydrocarbon feed, the liquid water can be contacted with the preheated hydrocarbon feed before the steam. In other embodiments, when both liquid water and steam are mixed with the preheated hydrocarbon feed, the liquid water can be contacted with the preheated heavy hydrocarbon feed after the steam. In still other embodiments, when both liquid water and steam are mixed with the preheated hydrocarbon feed, the liquid water and the steam can be contacted with the preheated hydrocarbon feed at substantially the same time.

The mixing of the preheated hydrocarbon feed and the liquid water and, optionally, the steam to produce the mixture in line 1037 can occur inside or outside the furnace 1007, but preferably it occurs outside the furnace 1007. The mixing can be accomplished using any mixing device known in the art. In some embodiments, a mixing device, e.g., a sparger, can be used to mix the preheated hydrocarbon feed in line 1015 with the liquid water in line 1003. When the steam in line 1003 is mixed with the preheated hydrocarbon feed in line 1015 a second mixing device, e.g., a second sparger, can be used to mix the preheated hydrocarbon feed in line 1015 or the mixture of the preheated hydrocarbon feed and liquid water. In some embodiments, a double sparger assembly can be used for the mixing. Suitable double sparger assemblies can include those described in U.S. Pat. Nos. 7,090,765 and 7,138,047. The mixture produced by mixing the preheated hydrocarbon feed with the liquid water and optionally the steam can be referred to as a hydrocarbon feed-water mixture in line 1037. It should be understood the liquid water, while in the liquid phase upon initial contact with the preheated hydrocarbon feed in line 1015, can at least partially or completely vaporize upon contact with the preheated hydrocarbon feed such that at least a portion of the liquid water is in the vapor phase in the hydrocarbon feed-water mixture.

In some embodiments, the amount of liquid water in line 1003 that can be combined with the preheated hydrocarbon feed in line 1015 can be in a range of from 1 wt %, 2 wt %, 5 wt %, or 10 wt % to 15 wt %, 20 wt %, 30 wt %, 40 wt %, or 50 wt %, based on a combined weight of the preheated hydrocarbon feed and the water. In some embodiments, when the liquid water in line 1003 and the steam in line 1005 are combined with the preheated hydrocarbon feed to produce the mixture in line 1037, the amount of the liquid water combined with the preheated hydrocarbon feed and the steam can be in a range of from 1 wt %, 2 wt %, 3 wt %, 4 wt %, 5 wt %, 10 wt %, 20 wt %, 30 wt %, 40 wt %, or 45 wt % to 50 wt %, 60 wt %, 70 wt %, 80 wt %, 90 wt %, 95 wt %, 99 wt %, or 99.9 wt %, based on the combined weight of the liquid water and the steam.

The steam in line 1005, if used, can have a temperature greater, lower or about the same as, but preferably greater than the preheated hydrocarbon feed or a mixture of the preheated hydrocarbon feed and the liquid water. The steam in line 1005 can partially vaporize the hydrocarbon feed. In some embodiments, the steam in line 1005 can be superheated before being mixed with the preheated hydrocarbon feed or the mixture of the hydrocarbon feed and the liquid water.

The mixture of the water, the preheated hydrocarbon feed, and optionally the steam in line 1037 can be heated in the furnace 1007. In some embodiments, the heating can be accomplished by passing the mixture through a bank of heat exchange tubes 1039 located within the convection section 1009 of the furnace 1007 and thus heated by the hot flue gas from the radiant section 1011 of the furnace 1007. The heated mixture can leave the convection section 1009 as a heated mixture via line 1041 and can, optionally, be further mixed with one or more additional steam streams (not shown). The heated mixture in line 1041 can be at a temperature in a range of from 200° C., 300° C., 350° C., or 400° C. to 500° C., 600° C., 700° C., or 750° C.

The heated mixture or at least a portion thereof in line 1041 can be introduced into one or more radiant coils 1017 disposed within the radiant section 1011 of the steam cracker furnace 1007 and cracked therein to produce a steam cracker effluent via line 1043. The steam cracking conditions within the radiant section 1011 of the steam cracker 1007 can include, but are not limited to, one or more of: exposing the heated mixture to a temperature (as measured at a radiant outlet of the steam cracker 116) of ≥400° C., e.g., a temperature of about 700° C., about 800° C., or about 900° C. to about 950° C., about 1,000° C., or about 1050° C., a pressure of about 0.1 bar to about 5 bars (absolute), and/or a steam cracking residence time of about 0.01 seconds to about 5 seconds. In some embodiments, the heated mixture in line 1041 can be steam cracked according to the processes and systems disclosed in U.S. Pat. Nos. 6,419,885; 7,993,435; 9,637,694; and 9,777,227; U.S. Patent Application Publication No. 2018/0170832; and International Patent Application Publication No. WO 2018/111574.

The steam cracker effluent in line 1043 can be at a temperature of ≥300° C., ≥400° C., ≥500° C., ≥600° C., or ≥700° C., or ≥800° C., or more. In some embodiments, the steam cracker effluent in line 1043 can be at a temperature in a range of from 400° C., 500° C., 600° C., 700° C., or 800° C. to 900° C., 950° C., 1,000° C., or 1,050° C. The steam cracker effluent in line 1043 can be cooled to produce a cooled steam cracker effluent. For example, the steam cracker effluent in line 1042 can be directly contacted with an optional quench fluid and/or indirectly cooled via one or more heat exchangers, e.g., a transfer line exchanger "TLE", in a heat exchange stage 1045 to produce a cooled steam cracker effluent via line 1045.

As shown, the cooled steam cracker effluent via line 1047 can be introduced into a separation stage, e.g., a primary fractionator, 1049. The cooled stream cracker effluent can be separated within the separation stage 1049 to provide a bottoms or tar product via line 1051, a steam cracker quench oil via line 1053, a steam cracker gas oil via line 1055, and an overhead product that includes a steam cracker naphtha and a process gas via line 1057. In some embodiments, the cooled steam cracker effluent via line 1047 can be introduced into one or more separation stages, e.g., a tar knock out drum, to separate the tar product and a light product therefrom, with the light product then introduced into the separation stage 1049. Suitable separation stages the cooled steam cracker effluent in line 1047 can optionally be introduced to can include those disclosed in U.S. Pat. Nos. 7,674,366; 7,718,049; 8,083,931; 8,092,671; 8,105,479.

The overhead product via line 1057 can be introduced into a quench tower 1059 along with quench water, e.g., a recycled quench water, via line 1061 to cool the overhead product in line 1057. In some embodiments, the recycled quench water in line 1061 can be cooled, e.g., by air and/or water, pro to introduction into the quench tower 1059. In some embodiments, the recycled quench water in line 1061 can be recycled to the quench tower 1059 as a single return and/or split into multiple returns to the quench tower 1059 and/or other process equipment.

An overhead or process gas via line 1063 and a mixture that includes steam cracker naphtha and quench water via line 1065 can be conducted away from the quench tower 1059. The process gas in line 1063 can include molecular hydrogen and $C_1$-$C_5$-hydrocarbons, e.g., $C_1$-$C_9$ hydrocarbons. In some embodiments, the process gas in line 1063 can be or can include, but is not limited to, molecular hydrogen, one or more $C_1$-$C_5$ alkanes, one or more $C_2$-$C_5$ alkenes, and one or more contaminants, or a mixture thereof. It should be understood that while shown as being separate vessels the quench tower 1059 can be integrated with the separation stage 1049.

The mixture of steam cracker naphtha and quench water in line 1065 can be introduced into one or more separators 1067. A steam cracker naphtha via line 1069, condensed process water via line 1071, and the recycle quench water via line 1061 can be conducted away from the separator 1067. A portion of the steam cracker naphtha in line 1069 can be recycled via line 1070 to the separation stage 1049 as a reflux and a portion of the steam cracker naphtha in line 1069 can be removed via line 1074 from the system 100.

The condensed process water via line 1071 can be introduced into a process water stripper 1073. Entrained hydrocarbons, hydrogen sulfide, and/or other possible contaminants can be separated from the condensed water and can be recovered as an overhead via line 1075 and a purified process water can be recovered as a bottoms via line 1077.

A pH within the process water stripper 1073 can be controlled by introducing an amine via line 1079 into the condensed process water in line 1071. Suitable amines that can be introduced via line 1079 into the condensed process water in line 1071 can be or can include, but are not limited to, one or more of ammonia, ammonium, one or more ammonium cations or compounds, or any mixture thereof. As used herein, the term "amine" means compounds and functional groups that contain a basic nitrogen atom with a lone pair (i.e., unshared pair or non-bonding pair) of valence electrons, and encompasses all primary, secondary, and tertiary amines. Ammonium cations or compounds can be or include, but are not limited to, one or more of those cations or compounds having the chemical formula $[R_xNH_{(4-x)}]^+$, where x is 0, 1, 2, 3, or 4, and each R is independently selected from among alkyl, aryl (such as phenyl), or other organic groups. Exemplary ammonium cations or compounds can be or include, but are not limited to, one or more of ammonium, methylammonium, tetramethylammonium, ethylammonium, and salts of any of these. The term "amine" means compounds and functional groups that contain a basic nitrogen atom with a lone pair (i.e., unshared pair or non-bonding pair) of valence electrons, and encompasses all primary, secondary, and tertiary amines. Amine can be or include, but are not limited to, one or more of those having the chemical formula $R_xNH_{(3-x)}$, where x is 1, 2, or 3, and each R is independently selected from among alkyl, aryl (such as phenyl), or other organic groups. Exemplary amines can be or include, but are not limited to, one or more of methylamine, dimethylamine, trimethylamine, ethylamine, diethylamine, triethylamine, methylethylamine (MEA), phenylamine, and salts of any of these.

In some embodiments, the pH within the process water stripper 1073 can be controlled with by only introducing one or more amines via line 1079 into the process water stripper 1073. As such, in some embodiments, control of the pH within the process water stripper 1073 can be accomplished without the use of any sodium containing compound such as sodium hydroxide.

In some embodiments, the condensed process water via line 1077 can be introduced into a dilution steam generator 1081 to produce dilution steam via line 1083 and wastewater or "blow down" via line 1085. In some embodiments, at least a portion of the dilution steam in line 1083 can be routed via line 1087 to line 1005 to make up at least a portion of the steam in line 1005 or elsewhere. In some embodiments, at least a portion of the dilution steam in line 1083 can be introduced via line 1089 into one or more heat exchange stages 1091 to produce a condensed dilution steam via line 1093.

As noted above, in some embodiments, a portion of the condensed process water in line 1071 can be recycled via line 1072 to make up at least a portion of the liquid water in line 1003 that can be combined with the preheated hydrocarbon feed in line 1015. In other embodiments, a portion of the purified process water in line 1077 can be recycled via line 1078 to make up at least a portion of the liquid water in line 1003 that can be combined with the preheated hydrocarbon feed in line 1015. In other embodiments, at least a portion of the condensed dilution steam in line 1093 can be recycled to make up at least a portion of the liquid water in line 1003 that can be combined with the preheated hydrocarbon feed in line 1015. In some embodiments, all of the liquid water in line 1003 that can be combined with the preheated hydrocarbon feed in line 1015 can be made up of the portion of the condensed process water in line 1072, the purified process water in line 1078, the condensed dilution steam in line 1093, or a mixture thereof. In other embodiments, the liquid water in line 1003 that can be combined with the preheated hydrocarbon feed in line 1015 can be made up of at least one of the condensed process water in line 1072, the purified process water in line 1078, and the condensed dilution steam in line 1093 and fresh boiler feed water (or other water) in line 1002 can also be introduced into line 1003 to make up the liquid water in line 1003 that can be combined with the preheated hydrocarbon feed in line 1015.

Figure 2:
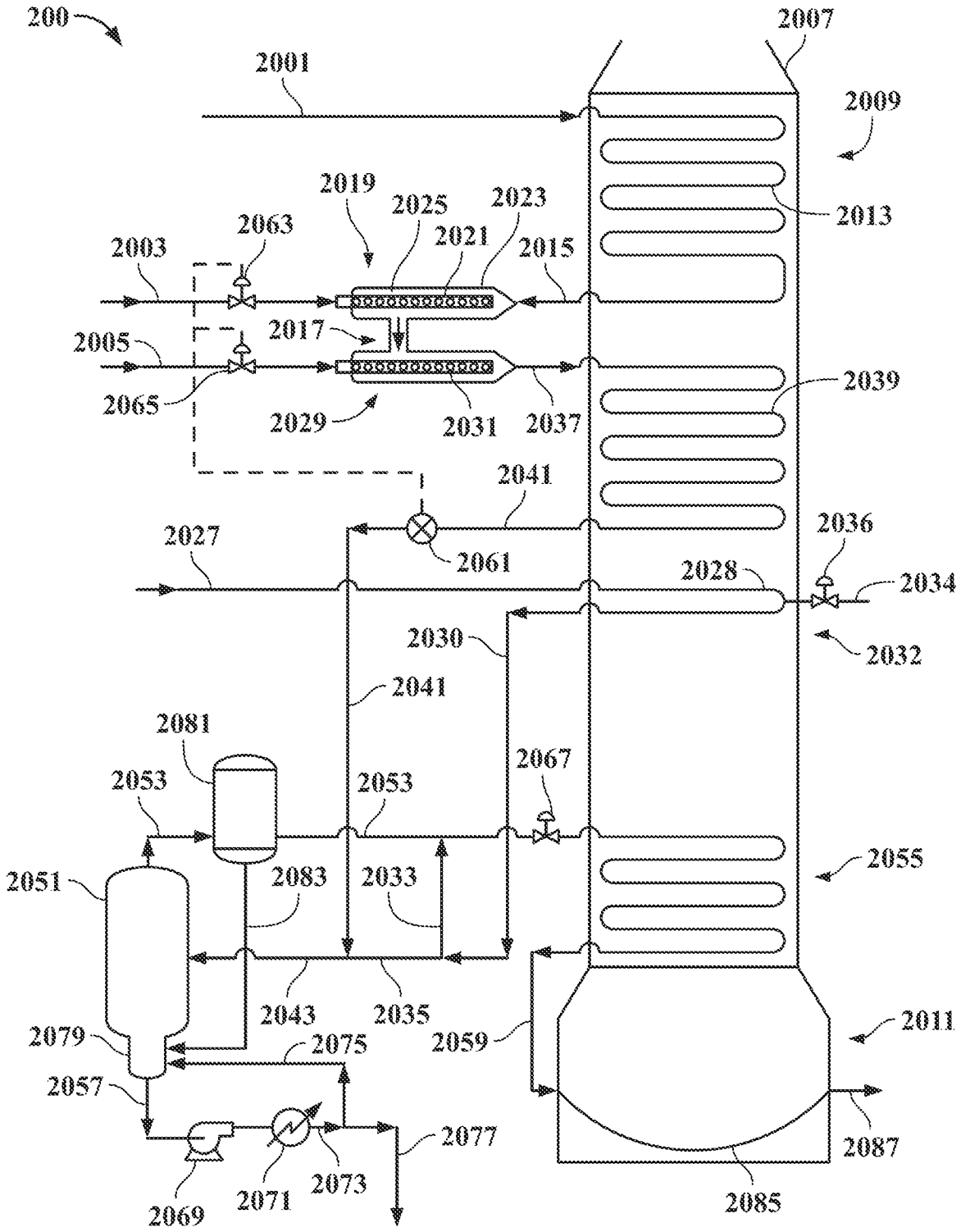
FIG. 2 depicts a schematic of an illustrative steam cracker system that contacts a heavy hydrocarbon feed with water and steam during heating, separates a vapor fraction and a liquid fraction, and steam cracks the vapor fraction within a radiant section of a stream cracker furnace, according one or more embodiments described.

FIG. 2 depicts a schematic of an illustrative steam cracker system 200 that contacts a heavy hydrocarbon feed in line 2001 with water in line 2003 and steam in line 2005 during heating, separates a vapor fraction via line 2053 and a liquid fraction via line 2057, and steam cracks the vapor fraction within a radiant section 2011 of a stream cracker furnace 2007, according one or more embodiments. The hydrocarbon feed in line 2001 can include a large portion, e.g. 5 wt % to 50 wt %, of heavy non-volatile components. Such heavy hydrocarbon feed can be or can include crude oil or a fraction thereof. In some embodiments, the hydrocarbon feed can be or can include, but is not limited to, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric resid, heavy residium, C4's/residue admixture, naphtha residue admixture, or any mixture thereof. The heavy hydrocarbon feed can have a nominal end boiling point of at least 310° C. A preferred heavy hydrocarbon feed can include low sulfur waxy resids, atmospheric resids, and naphthas contaminated with crude. In some embodiments, a preferred heavy hydrocarbon feed can include a resid that can include 60 wt % to 80 wt % of components having boiling points below 590° C., for example, low sulfur waxy resids.

The heavy hydrocarbon feed in line 2001 can be first preheated in an upper convection section 2009. The heating of the heavy hydrocarbon feed can take any form known by those of ordinary skill in the art. However, it can be preferred that the heating includes indirect contact of the heavy hydrocarbon feed in the upper convection section 2009 of the furnace 2007 with hot flue gases from the radiant section 2011 of the furnace 2007 to produce a preheated heavy hydrocarbon feed in line 2015. This can be accomplished, by way of a non-limiting example, by passing the heavy hydrocarbon feed through a bank of heat exchange tubes 2013 located within the convection section 2009 of the furnace 2007. In some embodiments, the preheated feed in line 2015 can have a temperature of 150° C., 160° C., or 170° C. to 220° C., 240° C., or 260° C.

The preheated heavy hydrocarbon feed in line 2015 can be mixed with liquid water in line 2003. In some embodiments, the preheated heavy hydrocarbon feed in line 2015 can be mixed with the liquid water in line 2003 and steam, e.g., primary dilution steam, in line 2005. In some embodiments, when both liquid water and steam are mixed with the preheated heavy hydrocarbon feed, the liquid water can be contacted with the preheated heavy hydrocarbon feed before the steam. In other embodiments, when both liquid water and steam are mixed with the preheated heavy hydrocarbon feed, the liquid water can be contacted with the preheated heavy hydrocarbon feed after the steam. In still other embodiments, when both liquid water and steam are mixed with the preheated heavy hydrocarbon feed, the liquid water and the steam can be contacted with the preheated heavy hydrocarbon feed at substantially the same time.

The mixing of the preheated heavy hydrocarbon feed and the liquid water and, optionally, the steam can occur inside or outside the furnace 2007, but preferably it occurs outside the furnace 2007. It should be noted that the steam cracker system 200 shown in FIG. 2 mixes both liquid water and steam, but the steam can be excluded in some embodiments. The mixing can be accomplished using any mixing device known within the art. In some embodiments, a mixing device, e.g., a first sparger, 2019 of a double sparger assembly 2017 can be used for the mixing. The first sparger 2019 can include an inside perforated conduit 2021 surrounded by an outside conduit 2023 so as to form an annular flow space 2025 between the inside conduit 2021 and the outside conduit 2023. Preferably, the preheated heavy hydrocarbon feed flows in the annular flow space and the water flows through the inside conduit 2021 and is injected into the heavy hydrocarbon feed through the openings in the inside conduit 2021, preferably small circular holes. The first sparger 2019 can reduce or avoid hammering caused by sudden vaporization of the water, upon contact of the water with the preheated heavy hydrocarbon feed. The mixture produced by mixing the preheated heavy hydrocarbon feed with the water can be referred to as a heavy hydrocarbon feed-water mixture.

The process can use steam streams in various parts thereof. The primary dilution steam stream in line 2005 can be mixed with the preheated heavy hydrocarbon feed as detailed below. In some embodiments, a secondary dilution steam stream in line 2027 can be heated in the convection section 2009 within one or more heat exchange tubes 2028 to produce a heated secondary dilution steam via line 2030. In some embodiments, at least a portion of the heated secondary dilution steam in line 2030 can be mixed with the heated mixture in line 2041 before a flash drum 2051. The secondary dilution steam 2027 can optionally be split into a bypass steam stream via line 2033 and a flash steam stream via line 2035.

In some embodiments, in addition to the water mixed with the preheated heavy hydrocarbon feed, the primary dilution steam in line 2005 can also be mixed with the preheated heavy hydrocarbon feed and/or the heavy hydrocarbon feed-water mixture. The primary dilution steam stream via line 2005 can be injected into a second sparger 2029. In some embodiments, the primary dilution steam stream via line 2005 can be injected into the heavy hydrocarbon feed-water mixture before the resulting stream mixture enters the convection section 2009 via line 2037 for additional heating by radiant section flue gas. Even more preferably, the primary dilution steam via line 2005 can be injected directly into the second sparger 2029 so that the primary dilution steam passes through the sparger and is injected through small circular flow distribution holes 2031 into the hydrocarbon feedstock-water mixture.

The primary dilution steam in line 2005 can have a temperature greater, lower or about the same as the heavy hydrocarbon feed-water mixture but preferably greater than that of the mixture and serves to partially vaporize the hydrocarbon feed-water mixture. Preferably, the primary dilution steam is superheated before being injected via line 2005 into the second sparger 2029.

The mixture of the water, the preheated heavy hydrocarbon feed, and the primary dilution steam stream leaving the second sparger 2029 via line 2037 can be heated again in the furnace 2007 before flashing the mixture in the flash drum 2051. In some embodiments, the heating can be accomplished by passing the mixture through a bank of heat exchange tubes 2039 located within the convection section 2009 of the furnace 2007 and thus heated by the hot flue gas from the radiant section 2011 of the furnace 2007. The thus-heated mixture can leave the convection section 2009 as a heated mixture via line 2041 and can, optionally, be further mixed with one or more additional steam streams.

The heated mixture of water, heavy hydrocarbon feed, and primary dilution steam stream (the flash stream 2043) can be introduced into the flash drum 2051 for separation into two phases: a vapor phase comprising predominantly volatile hydrocarbons and a liquid phase comprising predominantly non-volatile hydrocarbons. The vapor phase can be removed from the flash drum as an overhead vapor stream via line 2053. In some embodiments, the vapor phase via line 2053 can be fed back to a lower convection section 2055 of the furnace 2007 for optional heating and through crossover pipes to the radiant section 2011 of the furnace 2007 for cracking. The liquid phase or bottoms stream of the separation can be removed via line 2057 from the flash drum 2051.

As noted above, the secondary dilution steam stream in line 2027 can optionally be split into a bypass steam stream via line 2033 and a flash steam stream via line 2035. The flash steam stream via line 2035 can be mixed with the heated mixture in line 2041 to produce the flash stream in line 2043 before the flash and the bypass steam stream via line 2033 can bypass the flash of the heated mixture in line 2041 and, instead can be mixed with a vapor phase in line 2053 recovered from the flash drum 2051 before the vapor phase is cracked in the radiant section 2011 of the furnace 2007. In some embodiments, the process can operate with all secondary dilution steam in line 2027 used as flash steam via line 2035 with no bypass steam via line 2033. Alternatively, the process can be operated with secondary dilution steam in line 2027 directed to bypass steam via line 2033 with no flash steam via line 2035. In some embodiments, the ratio of the flash steam stream in line 2035 to the bypass steam stream in line 2033 can be 1:20 to 20:1 or more preferably 1:2 to 2:1. The flash steam in line 2035 can be mixed with the heated mixture in line 2041 to form the flash stream in line 2043 before the flash in the flash drum 2051. Preferably, the secondary dilution steam stream can be superheated in a superheater section 2032 in the furnace 2007 before splitting and mixing with the heated mixture in line 2041 and/or the vapor phase in line 2053. The addition of the flash steam stream in line 2035 to the heated mixture in line 2041 can help ensure the vaporization of nearly all volatile components of the mixture before the flash stream 2043 enters the flash drum 2051.

In some embodiments, a predetermined ratio of vapor to liquid can be substantially maintained in the flash drum 2051. But such ratio can be difficult to measure and control. As an alternative, the temperature of the heated mixture in line 2041 before the flash drum 2051 can be used as an indirect parameter to measure, control, and maintain the vapor to liquid ratio in the flash drum 2051. Ideally, when the temperature of the heated mixture in line 2041 is higher, more volatile hydrocarbons will be vaporized and become available, as a vapor phase, for cracking. However, when the temperature of the heated mixture in line 2041 is too high, more heavy hydrocarbons will be present in the vapor phase and carried over to the convection furnace tubes, eventually coking the tubes. If the temperature of the heated mixture in line 2041 is too low, hence a low ratio of vapor to liquid in the flash drum 2051, more volatile hydrocarbons will remain in liquid phase and thus will not be available for cracking. Conventional flash drums can be utilized to do this, though the invention is not limited thereto. Examples of such conventional flash drums can include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705.

The temperature of the heated mixture in line 2041 can be limited by highest recovery/vaporization of volatiles in the feed while avoiding coking in the furnace tubes or coking in piping and vessels conveying the mixture from the flash drum 2051 to the furnace 2007. The pressure drop across the piping and vessels conveying the mixture to the lower convection section 2055, and the crossover piping 2059, and the temperature rise across the lower convection section 2055 can be monitored to detect the onset of coking problems. For example, when the crossover pressure and process inlet pressure to the lower convection section 2055 begins to increase rapidly due to coking, the temperature in the flash drum 2051 and the heated mixture in line 2041 can be reduced. If coking occurs in the lower convection section 2055, the temperature of the flue gas to the superheater section 2032 can be increased, requiring more desuperheater water via line 2034.

The selection of the temperature of the heated mixture in line 2041 can also be determined by the composition of the heavy hydrocarbon feed in line 2001. When the heavy hydrocarbon feed contains higher amounts of lighter hydrocarbons, the temperature of the heated mixture in line 2041 can be set lower. As a result, the amount of water used in the first sparger 2019 can be increased and/or the amount of primary dilution steam used in the second sparger 2029 can be decreased since these amounts directly impact the temperature of the heated mixture in line 2041. When the heavy hydrocarbon feed in line 2001 contains a higher amount of non-volatile hydrocarbons, the temperature of the heated mixture in line 2041 can be set higher. As a result, the amount of water used in the first sparger 2019 can be decreased while the amount of primary dilution steam used in the second sparger 2029 can be increased. By selecting an appropriate temperature of the heated mixture in line 2041, the process can find applications in a wide variety of heavy hydrocarbon feed materials. Typically, the temperature of the heated mixture in line 2041 can be set and controlled at a temperature in the range of from 310° C. to 510° C., preferably between 370° C. and 490° C., more preferably between 400° C. and 480 CC, and most preferably between 430° C. and 475° C.

The temperature of heated mixture in line 2041 can be controlled by a control system 2061 that can include at least a temperature sensor and any known control device, such as a computer application. Preferably, the temperature sensors are thermocouples. The control system 2061 can communicate with a water valve 2063 and a primary dilution steam valve 2065 so that the amount of the water and the primary dilution steam entering the two spargers 2019 and 2029, respectively, can be controlled.

In order to maintain a desired temperature for the heated mixture in line 2041 mixing with flash steam 2035 and entering the flash drum 2051 to achieve a desired ratio of vapor to liquid in the flash drum 2051 and to avoid substantial temperature and flash vapor to liquid ratio variations, the process can be operated as follows. When a temperature of the heated mixture in line 2041 before the flash drum 2051 is set, the control system 2061 can automatically control the water valve 2063 and the primary dilution steam valve 2065 on the two spargers 2019 and 2029, respectively. When the control system 2061 detects a drop in temperature of the heated mixture in line 2041, the controller 2061 can cause the water valve 2063 to reduce the injection of the water into the first sparger 2019. If the temperature of the heated mixture in line 2041 starts to rise, the water valve 2063 can be further opened to increase the injection of the water into the first sparger 2019. In some embodiments, the water latent heat of vaporization can control the temperature of the heated mixture in line 2041.

When the primary dilution steam stream 2005 is injected to the second sparger 2029, the temperature control system 2061 can also be used to control the primary dilution steam valve 2065 to adjust the amount of primary dilution steam stream injected into the second sparger 2029. This can further reduce the sharp variation in temperature changes in the flash drum 2051. When the control system 2061 detects a drop of temperature of the mixture stream 2041, the controller 2061 can instruct the primary dilution steam valve 2065 to increase the injection of the primary dilution steam stream into the second sparger 2029 while valve 2063 can be further closed. If the temperature starts to rise, the primary dilution steam valve 2065 can be closed more to reduce the amount of primary dilution steam stream injected into the second sparger 2029 while valve 2063 can be further opened.

In some embodiments, the control system 2061 can be used to control both the amount of the water via line 2003 and the amount of the primary dilution steam stream via line 2005 to be injected into both spargers 2019 and 2029. In some embodiments, the controller 2061 can vary the amount of water and primary dilution steam to maintain a constant temperature of the heated mixture in line 2041, while maintaining a constant ratio of water-to-feedstock in the mixture in line 2037. In some embodiments, to further reduce or avoid a sharp variation of the flash temperature, an intermediate desuperheater water via line 2034 can be introduced by controlling valve 2036 in the superheating section 2032 of the secondary dilution steam in the furnace 2007. This can allow the superheating section 2032 outlet temperature to be controlled at a substantially constant value, independent of furnace load changes, coking extent changes, and/or excess oxygen level changes. Normally, this desuperheater water in line 2034 can help ensure that the temperature of the secondary dilution steam is between 430° C. to 590° C., preferably between 450° C. to 540° C., more preferably between 450° C. to 510° C., and most preferably between 470° C. to 500° C. In some embodiments, the valve 2036 can be a control valve and water atomizer nozzle. After partial preheating, the secondary dilution steam can exit the convection section and a fine mist of the desuperheater water via line 2034 can be added which rapidly vaporizes and reduces the temperature. The steam can be further heated in the convection section. The amount of desuperheater water added can control the temperature of the steam which that can be mixed with heated mixture in line 2041.

In some embodiments, although it is preferred to adjust the amounts of the water and the primary dilution steam streams injected into the heavy hydrocarbon feedstock in the two spargers 2019 and 2029, according to the predetermined temperature of the heated mixture in line 2041 before the flash drum 2051, the same control mechanisms can be applied to other parameters at other locations. For example, the flash pressure and the temperature and the flow rate of the flash steam in line 2035 can be changed to effect a change in the vapor to liquid ratio in the flash. In another example, excess oxygen in the flue gas can be a control variable, albeit a slow one.

In addition to maintaining a constant temperature of the heated mixture in line 2041 entering the flash drum 2051, it can also be desirable to maintain a constant hydrocarbon partial pressure of the flash stream in line 2043 to maintain a constant ratio of vapor to liquid in the flash drum 2051. By way of example, the constant hydrocarbon partial pressure can be maintained by maintaining constant flash drum pressure through the use of control valve 2067 on the vapor phase line 2053, and by controlling the ratio of steam to heaving hydrocarbon feed in line 2043. Typically, the hydrocarbon partial pressure of the flash stream in line 2043 can be set and controlled at between 25 kPa-absolute 175 kPa-absolute, preferably between 35 kPa-absolute to 100 kPa-absolute, and most preferably between 40 kPa-absolute and 75 kPa-absolute.

The flash can be conducted in at least one flash drum 2051. Preferably, the flash can be a one-stage process with or without reflux. The flash drum 2051 can be operated at 275 kPa-absolute to 1,400 kPa-absolute and the temperature within the flash drum 2051 can be the same or slightly lower than the temperature of the flash stream 2043 before entering the flash drum 2051. The pressure within the flash drum 2051 can be 275 kPa-absolute, 600 kPa-absolute, 700 kPa-absolute, or 750 kPa-absolute to 760 kPa-absolute, 800 kPa-absolute, 1,000 kPa-absolute, 1,200 kPa-absolute, or 1,400 kPa-absolute and the temperature within the flash drum 2051 can be 310° C., 370° C., 400° C., or 430° C. to 480° C., 490° C., 500° C., or 510° C. Depending, at least in part, on the temperature of the flash stream, usually 50%, 60%, 65%, or 70% to 80%, 85%, 90%, or 95% of the mixture entering the flash drum 2051 can be vaporized to the upper portion of the flash drum.

In some embodiments, the flash drum 2051 can be operated to minimize the temperature of the liquid phase at the bottom of the vessel because too much heat can cause coking of the non-volatiles in the liquid phase. Use of the secondary dilution steam stream in line 2027 in the flash stream entering the flash drum 2051 can lower the vaporization temperature because it reduces the partial pressure of the hydrocarbons (i.e., larger mole fraction of the vapor is steam), and thus lowers the required liquid phase temperature. It can also be helpful to recycle a portion of the externally cooled flash drum bottoms liquid via line 2075 back to the flash drum 2051 to help cool the newly separated liquid phase at the bottom of the flash drum 2051. The bottoms stream recovered via line 2057 from the flash drum 2051 can be conveyed from the bottom of the flash drum 2051 to a cooler 2071 via pump 2069. The cooled stream in line 2073 can be split into a recycle stream 2075 and an export stream 2077. The temperature of the recycled stream can be 260° C., 263° C., 258°, or 270° C. to 288° C., 296° C., 302° C., or 320° C. The amount of the recycled stream in line 2075 can be 80%, 90%, 95%, or 100% to 200%, 210%, 225%, or 250% of the amount of the newly separated bottom liquid inside the flash drum 2051.

In some embodiments the flash drum 2051 can be operated to minimize the liquid retention/holding time in the flash drum 2051. In some embodiments, the liquid phase can be discharged from the flash drum 2051 through a small diameter "boot" or cylinder 2079 on the bottom of the flash drum 2051. The liquid phase retention time in the flash drum 2051 can be less than 75 seconds, less than 60 seconds, less than 30 seconds, or less than 15 seconds. The shorter the liquid phase retention/holding time in the flash drum 2051, the less coking occurs in the bottom of the flash drum 2051.

In the flash, the vapor phase 2053 can contain less than 400 ppm, less than 100 ppm, less than 80 ppm, or less than 50 ppm of non-volatiles. The vapor phase can be very rich in volatile hydrocarbons, e.g., 55 wt % to 70 wt % and steam, e.g., 30 wt % to 45 wt %). The boiling end point of the vapor phase can be less than 760° C., less than 600° C., less than 570° C., or less than 540° C. The vapor phase can be continuously removed from the flash drum 2051 through an overhead pipe which optionally conveys the vapor to a centrifugal separator 2081 that can remove at least a portion of any trace amounts of entrained liquid via line 2083 that can be recycled to the bottom of the flash drum 2051. The vapor can then flow into a manifold that can distribute the flow to the lower convection section 2055 of the furnace 2007.

The vapor phase in line 2053 removed from the flash drum 2051 can be superheated in the lower convection section 2055 to a temperature of, for example, 430° C. to 650° C. by the flue gas from the radiant section 2011 of the furnace 2007. The superheated vapor via line 2059 can then be introduced into one or more radiant coils or tubes 2085 disposed within the radiant section 2011 of the furnace 2007 to be cracked to produce a steam cracker effluent via line 2087. In some embodiments, the vapor phase via line 2053 removed from the flash drum 2051 can optionally be mixed with the bypass steam stream 2033 before being introduced into the furnace lower convection section 2055.

Hydrocarbon Feeds

The hydrocarbon feeds in lines 1001 and 2001 can be or can include crude oil or a fraction thereof. In some embodiments, the hydrocarbon feeds in line 1001 and 2001 can be or can include, but are not limited to, relatively high molecular weight hydrocarbons ("heavy feedstocks"), such as those that produce a relatively large amount of steam cracker tar ("SCT") during steam cracking. Examples of heavy feedstocks can include one or more of steam cracked gas oil and residues, gas oils, heating oil, jet fuel, diesel, kerosene, coker naphtha, steam cracked naphtha, catalytically cracked naphtha, hydrocrackate, reformate, raffinate reformate, Fischer-Tropsch liquids, Fischer-Tropsch gases, distillate, atmospheric pipestill bottoms, vacuum pipestill streams including bottoms, gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, or any mixture thereof. In some embodiments, the hydrocarbon feeds in lines 1001 and 2001 can be or can include, but are not limited to, lighter hydrocarbons such as $C_1$-$C_5$ alkanes, naphtha distillate, aromatic hydrocarbons, or any mixture thereof. In some embodiments, two or more hydrocarbon feeds can be introduced into the steam cracker and the two hydrocarbon feeds can be the same or different with respect to one another. In some embodiments, a first hydrocarbon feed can include one or more lighter hydrocarbons and a second hydrocarbon feed can include one or more heavy feedstocks. In some embodiments, the second hydrocarbon feed can have a nominal final boiling point ≥315° C., ≥399° C., ≥454° C., or ≥510° C. Nominal final boiling point means the temperature at which 99.5 wt % of a particular sample has reached its boiling point.

In other embodiments, the hydrocarbon feeds in line 1001 and 2001 can include one or more relatively low molecular weight hydrocarbon (light feedstocks), particularly those aspects where relatively high yields of $C_2$ unsaturates (ethylene and acetylene) can be desired. Light feedstocks can include substantially saturated hydrocarbon molecules having fewer than five carbon atoms, e.g., ethane, propane, and mixtures thereof (e.g., ethane-propane mixtures or "E/P" mix). For ethane cracking, a concentration of at least 75 wt. % of ethane is typical. For E/P mix, a concentration of at least 75 wt. % of ethane plus propane is typical, the amount of ethane in the E/P mix can be ≥20 wt. % based on the weight of the E/P mix, e.g., of about 25 wt. % to about 75 wt. %. The amount of propane in the E/P mix can be, e.g., ≥20 wt. %, based on the weight of the E/P mix, such as of about 25 wt. % to about 75 wt. %. In some embodiments, the hydrocarbon feed in line 1001 and 2001 can be or can include, but are not limited to, a refinery gas stream that can include one or more $C_2$ to $C_5$, saturated or unsaturated hydrocarbons. In some embodiments, a first hydrocarbon feed can include primarily ethane, propane, or a mixture thereof, and a second hydrocarbon feed can include a refinery gas stream. Suitable hydrocarbon feeds can be or can include those described in U.S. Pat. Nos. 7,138,047; 7,993,435; 8,696,888; 9,327,260; 9,637,694; 9,657,239; and 9,777,227; and International Patent Application Publication No. WO 2018/111574.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for steam cracking hydrocarbons, comprising:

heating a hydrocarbon feed to produce a preheated hydrocarbon feed;

combining liquid water with the preheated hydrocarbon feed to produce a mixture;

heating the mixture within a convection section of a steam cracker furnace to produce a heated mixture;

steam cracking at least a portion of the heated mixture within a radiant section of the steam cracker furnace to produce a steam cracker effluent;

separating a process gas comprising molecular hydrogen and $C_1$-$C_4$ hydrocarbons, a steam cracker naphtha, a condensed process water, and one or more heavy steam cracker products from the steam cracker effluent, wherein the condensed process water comprises entrained hydrocarbons;

separating at least a portion of the entrained hydrocarbons from the condensed process water to produce a purified process water, wherein the at least a portion of the entrained hydrocarbons is separated from the condensed process water within a process water stripper; and heating at least a portion of the purified process water to produce dilution steam, wherein the liquid water combined with the preheated hydrocarbon feed comprises at least one of the following: (i) a portion of the condensed process water, (ii) a portion of the purified process water, (iii) condensed dilution steam, and (iv) a mixture or two or more of (i), (ii), and (iii).

2. The process of claim 1, wherein the liquid water combined with the preheated hydrocarbon feed comprises the portion of the purified process water.

3. The process of claim 1, wherein the liquid water combined with the preheated hydrocarbon feed comprises the portion of the condensed process water.

4. The process of claim 1, wherein the liquid water combined with the preheated hydrocarbon feed comprises the condensed dilution steam.

5. The process of claim 1, wherein the liquid water combined with the preheated hydrocarbon feed comprises the portion of the purified process water and the portion of the condensed process water.

6. The process of claim 1, wherein the liquid water combined with the preheated hydrocarbon feed comprises the portion of the purified process water, the portion of the condensed process water, and the condensed dilution steam.

7. The process of claim 1, wherein an amount of liquid water combined with the preheated hydrocarbon feed is about 1 wt % to about 50 wt %, based on a combined weight of the preheated hydrocarbon feed and the liquid water.

8. The process of claim 1, wherein the hydrocarbon feed is heated within the convection section to produce the preheated hydrocarbon feed.

9. The process of claim 1, wherein the preheated hydrocarbon feed is at a temperature of 100° C. to 350° C.

10. The process of claim 1, wherein the heated mixture is at a temperature of 200° C. to 750° C.

11. The process of claim 1, wherein the steam cracker effluent is at a temperature of 400° C. to 1,050° C. upon exiting the radiant section of the steam cracker furnace.

12. The process of claim 1, wherein a pH within the process water stripper is controlled by introducing an amine into the process water stripper.

13. The process of claim 12, wherein the amine comprises ammonia, ammonium, one or more ammonium cations, or a mixture of two or more thereof.

14. The process of claim 12, wherein controlling the pH of the process water stripper does not utilize the introduction of any sodium containing compound into the process water stripper.

15. The process of claim 1, wherein the one or more heavy steam cracker products separated from the steam cracker effluent comprises a stream cracker tar, a steam cracker quench oil, a stream cracker gas oil, or a combination thereof.

16. The process of claim 1, wherein the hydrocarbon feed comprises crude oil or a fraction thereof.

17. The process of claim 1, further comprising separating a vapor phase product and a liquid phase product from the heated mixture, wherein the vapor phase product is steam cracked within the radiant section of the steam cracker furnace.

18. The process of claim 1, further comprising combining steam with the mixture, the heated mixture, or both the mixture and the heated mixture.

19. The process of claim 18, wherein the liquid water is combined with the preheated hydrocarbon feed before the steam.

20. The process of claim 18, wherein an amount of the liquid water combined with the preheated hydrocarbon feed and the steam is 1 wt % to 99.9 wt %, 2 wt % to 80 wt %, or 4 wt % to 50 wt %, based on the combined weight of the liquid water and the steam.

21. A system for steam cracking hydrocarbons, comprising:

a steam cracker comprising a convection section and a radiant section, wherein:

a first convection line is disposed within the convection section and configured to flow a hydrocarbon feed therethrough to produce a preheated hydrocarbon feed, a mixing device is in fluid communication with the first convection line and configured to receive the preheated hydrocarbon feed and a liquid water feed produce a mixture, a second convection line is disposed within the convection section and configured to receive and flow the mixture therethrough to produce a heated mixture, and a radiant line is disposed within the radiant section and configured to receive and flow at least a portion of the heated mixture therethrough to produce a steam cracker effluent;

a first separation stage configured to separate a process gas comprising molecular hydrogen and $C_1$-$C_4$ hydrocarbons, a steam cracker naphtha, a condensed process water, and one or more heavy steam cracker products from the steam cracker effluent, wherein the condensed process water comprises entrained hydrocarbons;

a second separation stage configured to separate at least a portion of the entrained hydrocarbons from the condensed process water to produce a purified process water;

a dilution steam generator configured to heat at least a portion of the purified process water to produce dilution steam; and at least one of:

a first recycle line configured to convey a portion of the condensed process water from the first separation stage to the mixing device to provide at least a portion of the liquid water received by the mixing device;

a second recycle line configured to convey a portion of the purified process water from the second separation stage to the mixing device to provide at least a portion of the liquid water received by the mixing device; and a third recycle line configured to convey a condensed dilution steam from an optional dilution steam condenser to the mixing device to provide at least a portion of the liquid water received by the mixing device.

22. The system of claim 18, wherein the mixing device comprises a first mixing device and a second mixing device, wherein the first mixing device is in fluid communication with the first convection line and configured to receive and combine the liquid water with the preheated hydrocarbon feed to produce the mixture; and wherein the second mixing device is in fluid communication with the first mixing device and configured to receive and combine steam with the mixture to produce a second mixture, wherein the second convection line is configured to receive and flow the second mixture therethrough to produce the heated mixture.

23. The system of claim 18, further comprising a third separation stage configured to separate a vapor phase product and a liquid phase product from the heated mixture, wherein the radiant line is configured to receive and flow at least a portion of the vapor phase product therethrough to produce the steam cracker effluent.

24. The system of claim 18, further comprising a heat exchange stage configured to produce a cooled steam cracker effluent by indirect heat exchange with a first heat transfer medium, by direct contact with a second heat transfer medium, or a combination thereof, wherein the first separation stage is configured to separate the process gas, the steam cracker naphtha, the condensed process water, and the one or more heavy steam cracker products from the cooled steam cracker effluent.

25. A process for steam cracking hydrocarbons, comprising:

heating a hydrocarbon feed to produce a preheated hydrocarbon feed;

combining liquid water with the preheated hydrocarbon feed to produce a mixture;

heating the mixture within a convection section of a steam cracker furnace to produce a heated mixture;

steam cracking at least a portion of the heated mixture within a radiant section of the steam cracker furnace to produce a steam cracker effluent;

separating a process gas comprising molecular hydrogen and $C_1$-$C_4$ hydrocarbons, a steam cracker naphtha, a condensed process water, and one or more heavy steam cracker products from the steam cracker effluent, wherein the condensed process water comprises entrained hydrocarbons;

separating at least a portion of the entrained hydrocarbons from the condensed process water to produce a purified process water; and heating at least a portion of the purified process water to produce dilution steam, wherein the liquid water combined with the preheated hydrocarbon feed comprises at least a portion of the purified process water.

* * * * *